US007175049B2

(12) United States Patent
Kastenschmidt et al.

(10) Patent No.: US 7,175,049 B2
(45) Date of Patent: Feb. 13, 2007

(54) DISPENSING CAP

(75) Inventors: Kevin R. Kastenschmidt, Onalaska, WI (US); Charles D. Weber, Onalaska, WI (US); Dennis P. Vosen, La Crosse, WI (US)

(73) Assignee: Hormel Foods, LLC, Austin, MN (US)

( * ) Notice: Subject to any disclaimer, the term of this patent is extended or adjusted under 35 U.S.C. 154(b) by 209 days.

(21) Appl. No.: 10/919,894

(22) Filed: Aug. 17, 2004

(65) Prior Publication Data

US 2006/0037967 A1 Feb. 23, 2006

(51) Int. Cl.
*B67D 5/00* (2006.01)

(52) U.S. Cl. ..... 222/81; 222/83.5; 222/85; 222/145.1; 222/145.5; 206/219; 206/222

(58) Field of Classification Search ..... 222/80–83, 222/85, 83.5, 145.5, 145.6, 145.1, 129; 206/219, 206/222; 220/276–277; 215/257, DIG. 8
See application file for complete search history.

(56) References Cited

U.S. PATENT DOCUMENTS

| | | | | | |
|---|---|---|---|---|---|
| 2,631,521 | A * | 3/1953 | Atkins, Jr. | ..... | 99/275 |
| 2,694,641 | A * | 11/1954 | Marshall et al. | ..... | 426/8 |
| 3,187,918 | A * | 6/1965 | Moore | ..... | 215/11.6 |
| 3,347,410 | A * | 10/1967 | Schwartzman | ..... | 222/80 |
| 3,548,562 | A * | 12/1970 | Schwartzman | ..... | 53/440 |
| 3,802,604 | A * | 4/1974 | Morane et al. | ..... | 222/83 |
| 4,103,772 | A | 8/1978 | Wiegner | | |
| 4,174,035 | A | 11/1979 | Wiegner | | |
| 4,465,183 | A | 8/1984 | Salto et al. | | |
| 4,770,305 | A * | 9/1988 | Su | ..... | 215/250 |
| 5,255,812 | A * | 10/1993 | Hsu | ..... | 220/277 |
| 5,884,759 | A * | 3/1999 | Gueret | ..... | 206/222 |
| 5,927,549 | A | 7/1999 | Wood | | |
| 6,059,443 | A * | 5/2000 | Casey | ..... | 366/130 |
| 6,148,996 | A | 11/2000 | Morini | | |
| 6,161,728 | A | 12/2000 | Dark | | |
| 6,230,884 | B1 | 5/2001 | Coory | | |
| 6,372,270 | B1 * | 4/2002 | Denny | ..... | 426/77 |
| 6,513,650 | B2 * | 2/2003 | Mollstam et al. | ..... | 206/222 |
| RE38,067 | E | 4/2003 | Gueret | | |
| 6,571,994 | B1 | 6/2003 | Adams et al. | | |
| 2002/0157970 | A1 | 10/2002 | Carlson | | |
| 2002/0157971 | A1 | 10/2002 | Carlson | | |
| 2002/0179461 | A1 | 12/2002 | Mollstam et al. | | |

FOREIGN PATENT DOCUMENTS

| | | |
|---|---|---|
| WO | WO 00/27717 | 5/2000 |
| WO | WO 01/36289 | 5/2001 |

* cited by examiner

*Primary Examiner*—Frederick C. Nicolas
(74) *Attorney, Agent, or Firm*—IPLM Group, P.A.

(57) ABSTRACT

A combination container and container cap (10) includes a container cap (11) having a deformable cover (14) on which a plurality of levers (15) are operatively connected. The levers (15) move from a first position to a second position, wherein the levers (15) move downward and radially outward to puncture a membrane (20) thereby allowing the substance in the container cap (11) to mix with a liquid (102) in a cavity (101) of a container (100).

14 Claims, 5 Drawing Sheets

DISPENSING CAP

BACKGROUND OF THE INVENTION

1. Field of the Invention

This invention relates generally to a method and apparatus for the dispensing of a liquid, dry substance or powder and more particularly to a method and apparatus for the dispensing of a liquid, dry substance or powder into a solution in a container on which the cap is operatively connected.

2. Description of the Prior Art

The prior art includes many dispensers for dispensing a liquid or dry substance, such as a dry powder or pellet into a liquid solution prior to consumption. Many of these have multiple complex components which increase the manufacturing costs as well as requiring specialized equipment to fill or to assemble a container. If the substance to be mixed is not a dry substance, but is instead another liquid, it is typically only necessary that the membrane holding the liquid be punctured, as the liquid will easily go through any ruptured hole. However, when a dry substance such as a powder or pellets is used, it is advantageous to have a larger hole to more easily allow the dry substance to drop into the solution in the main body of the container.

The present invention addresses the problems associated with the prior art and provides for a dispenser of a dry substance, such as a powder or pellets into a solution just prior to consumption.

SUMMARY OF THE INVENTION

In one embodiment, the invention is a container cap for use with a container having a cavity. The cavity is for holding a liquid. The cavity has an opening. The cap includes an outer peripheral wall forming an open bottom. The bottom and adapted and configured to operatively connect to the container. A deformable cover is operatively connected to the outer peripheral wall. The deformable cover has an inner surface and an outer surface. The deformable cover has a generally convex, first position and a generally concave, second position. A plurality of levers has a first end operatively connected to the inner surface. The levers point towards a center. A puncturable membrane is operatively connected to the cap and forms a storage area in the cap. The storage area is for storing a substance. The storage area includes the levers, wherein when the cover is depressed and moves from the first position to the second position, the lever is moved downward and radially outward, thereby puncturing the membrane and spreading out the punctured membrane creating an opening for the substance in the storage area to drop into the cavity.

In another embodiment, the invention is a container for holding a first substance separate from a liquid prior to mixing. The container includes a body having an open top. The body defines a cavity for holding a liquid. A cap has an outer peripheral wall forming an open bottom. The bottom is adapted and configured to be operatively connected to the open top of the body. A deformable cover is operatively connected to the outer peripheral wall. The deformable cover has an inner surface and an outer surface. The deformable cover has a generally convex, first position and a generally concave second position. A plurality of levers has a first end operatively connected to the inner surface. The levers point towards a center. A puncturable membrane is operatively connected to the cap forming a storage area in the cap. The storage area is for storing a substance. The storage area includes the levers, wherein when the cover is depressed and moves from the first position to the second position, the levers move downward and radially outward, thereby puncturing the membranes and spreading out the punctured membrane creating an opening for the substance in the storage area to drop into the cavity.

In another embodiment, the invention is a method of mixing a dry substance in a container cap in a liquid in a cavity of a container to make a drink. The container cap has a storage area sealed by a puncturable membrane. The cap has a plurality of levers having a first end connected to the inner surface of a cap cover. The levers point towards a center. The method includes depressing the cap cover toward the cavity. Moving the levers downward and outward by depressing the cap downward, thereby puncturing the membrane and spreading the punctured membrane creating an opening for the dry substance in the storage area to drop into the cavity. The container is shaken, thereby mixing the substance and liquid to create a drink. The cap is then removed, wherein the drink is available for consumption.

DETAILED DESCRIPTION OF A PREFERRED EMBODIMENT

Figure 1:
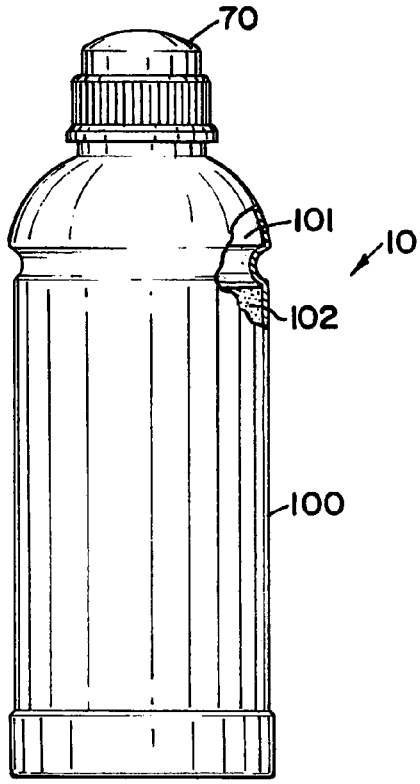
FIG. 1 is a front elevational view of a bottle of the present invention.

Referring to the drawing, wherein like numerals represent like parts throughout the several views, there is generally shown at 10 a combination container and container cap. The combination 10 includes a container cap 11 operatively connected to a container 100 and a clear top cap 70 positioned with a suitable snap fit or other means well known in the art on top of the container cap 11. The container cap 11 is suitably connected to the container 100 by means well known in the art. One such connection is to utilize screw threads 12 that are molded in the container cap 11 which in turn mate with a threaded neck (not shown) of the container 100. The container 100 may be of any suitable size or shape. A typical cylindrical shape is shown in FIG. 1. The container 100 has a cavity 101 in which a suitable liquid 102 is located. The level of the liquid 102 can vary as well as the type of liquid, depending upon the ultimate drink that is desired.

The container cap 11 has an outer peripheral wall 13 that forms an open bottom. As previously discussed, the bottom is adapted and configured to be operatively connected to the container 100 by a suitable method such as screw threads 12. A deformable cover 14 is operatively connected to the outer peripheral wall 13. Preferably, the outer peripheral wall 13 and the deformable cover 14 are an integral piece. The deformable cover 14 has an outer surface 14*a* and an inner surface 14*b*. A plurality of levers 15 are operatively connected to the inner surface 14*b*, and are preferably an integral portion of the deformable cover 14. The levers 15 have a first end 15*a* that is operatively connected to the deformable cover 14 and a free second end 15*b*. The first end 15*a* has a flange 16 to further secure the lever 15 to the deformable cover 14. The flange 16 also adds lateral stability for the levers 15. The deformable cover 14 includes a top member 17 and an outer circular vertical portion 18. The outer circular vertical portion 18 is a slightly smaller diameter than the outer peripheral wall 13 thereby creating a land 19 on to which a puncturable membrane 20 is secured by suitable means such as heat sealing.

Figure 2:
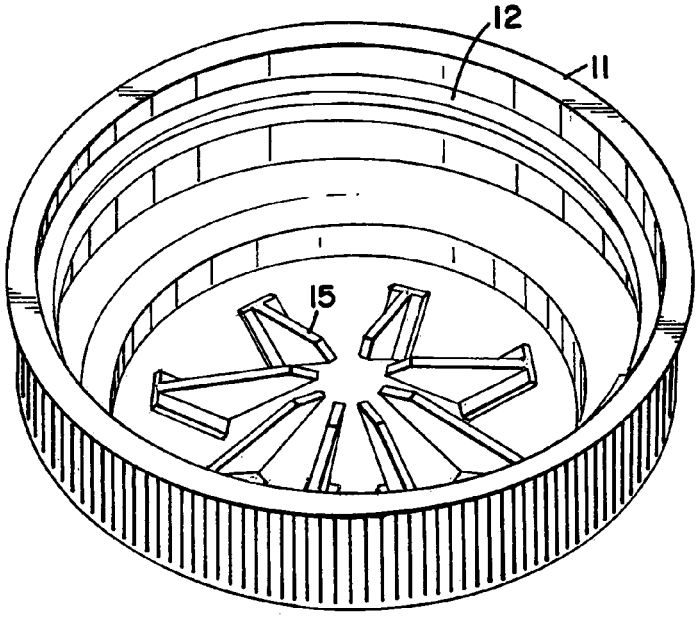
FIG. 2 is a perspective view of the container cap shown in FIG. 1, without a puncturable membrane, shown in a first position.
Figure 3:
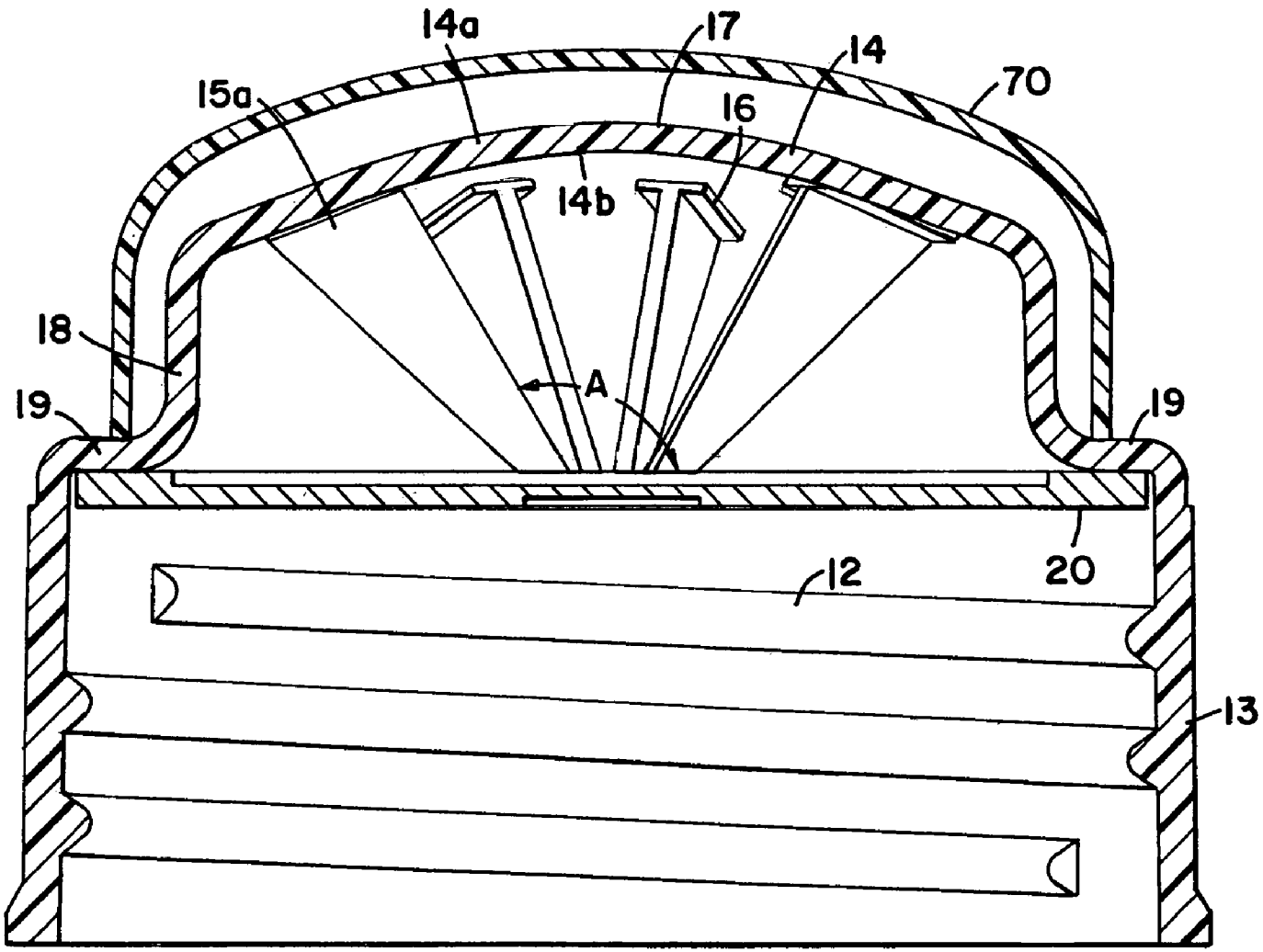
FIG. 3 is a cross sectional view of the container cap shown in FIG. 1 with a membrane.
Figure 4:
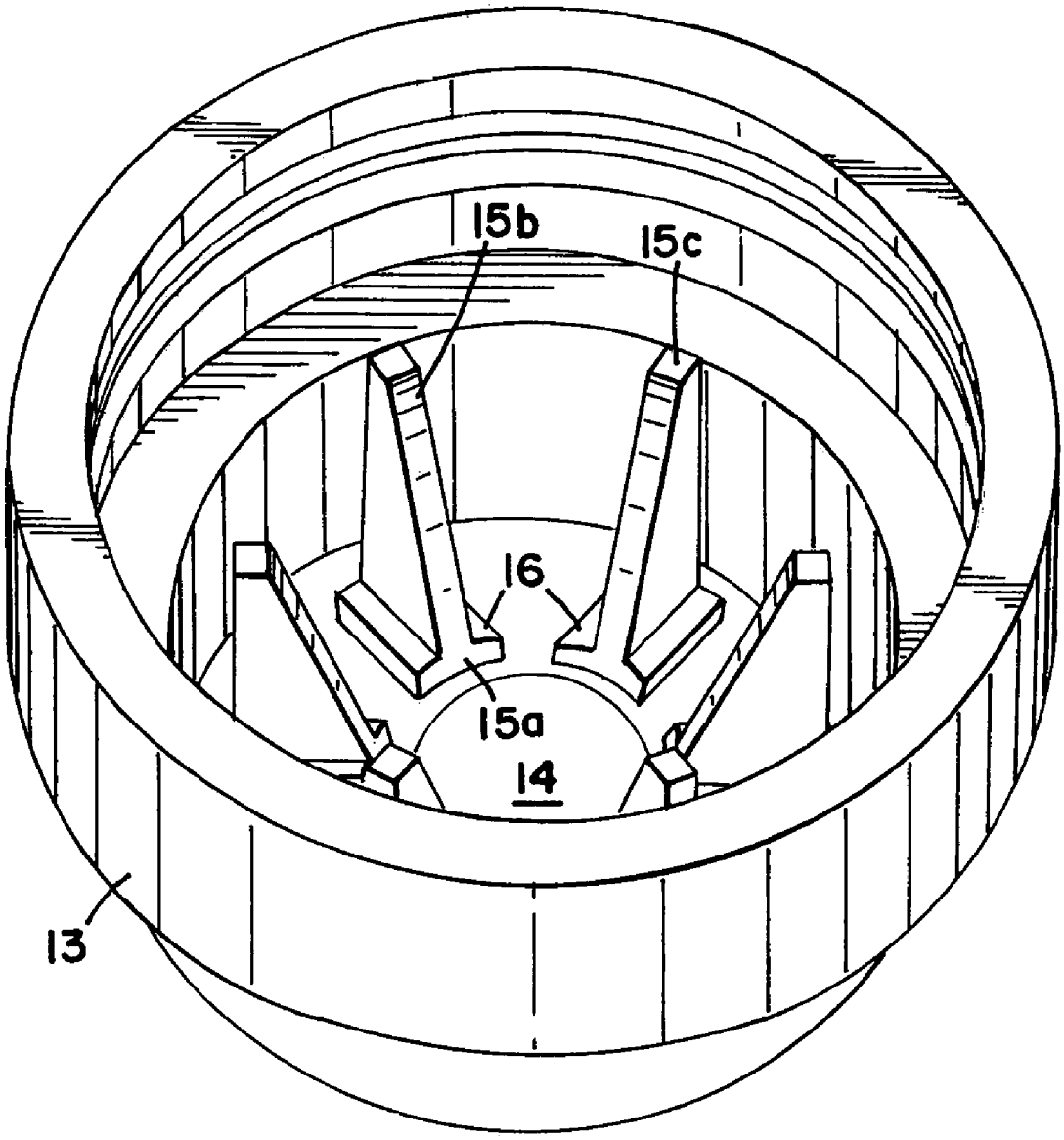
FIG. 4 is a perspective view of the container cap shown in FIG. 2, shown in a second position.
Figure 5:
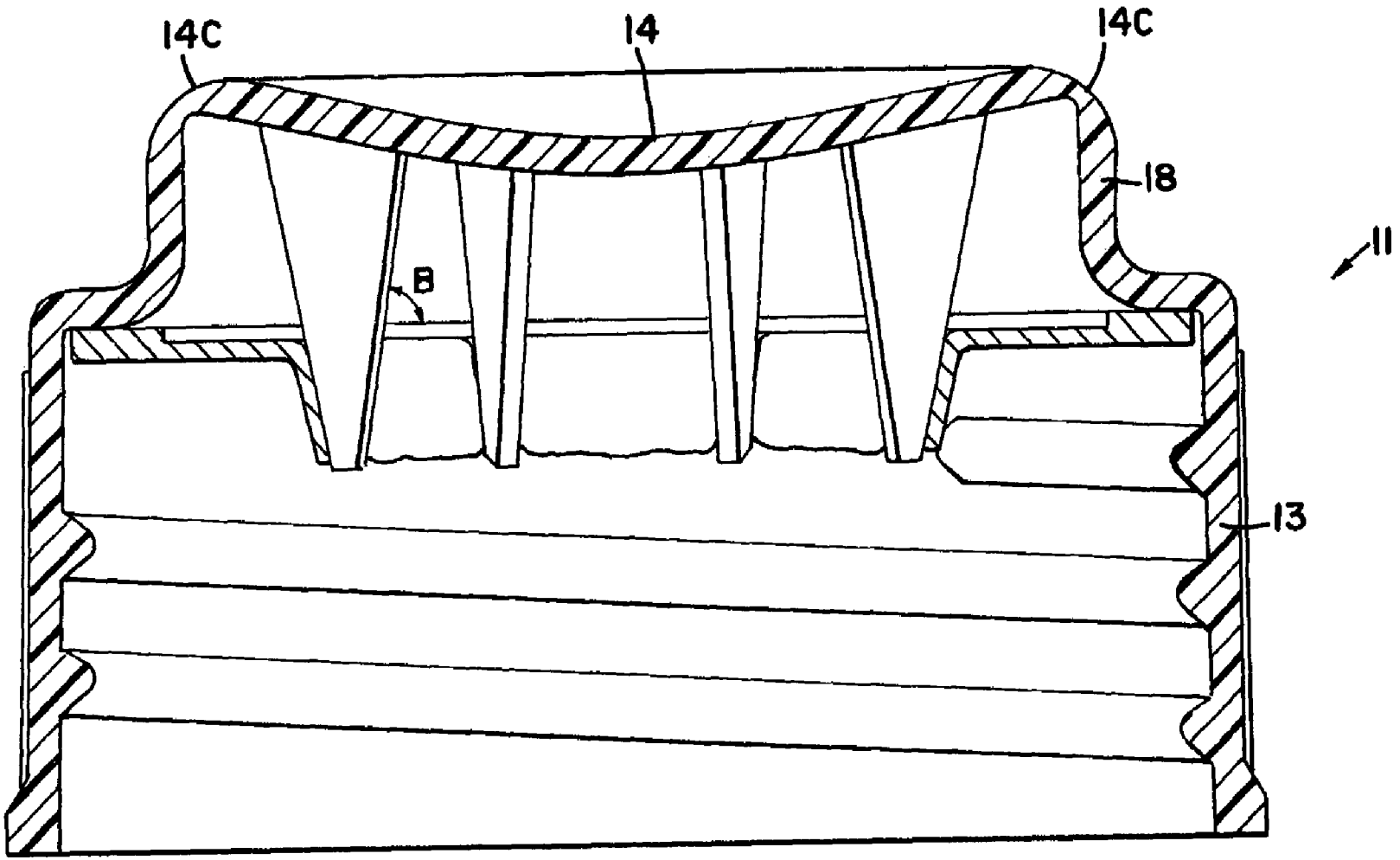
FIG. 5 is a cross sectional view of the container cap shown in FIG. 4.
Figure 6:
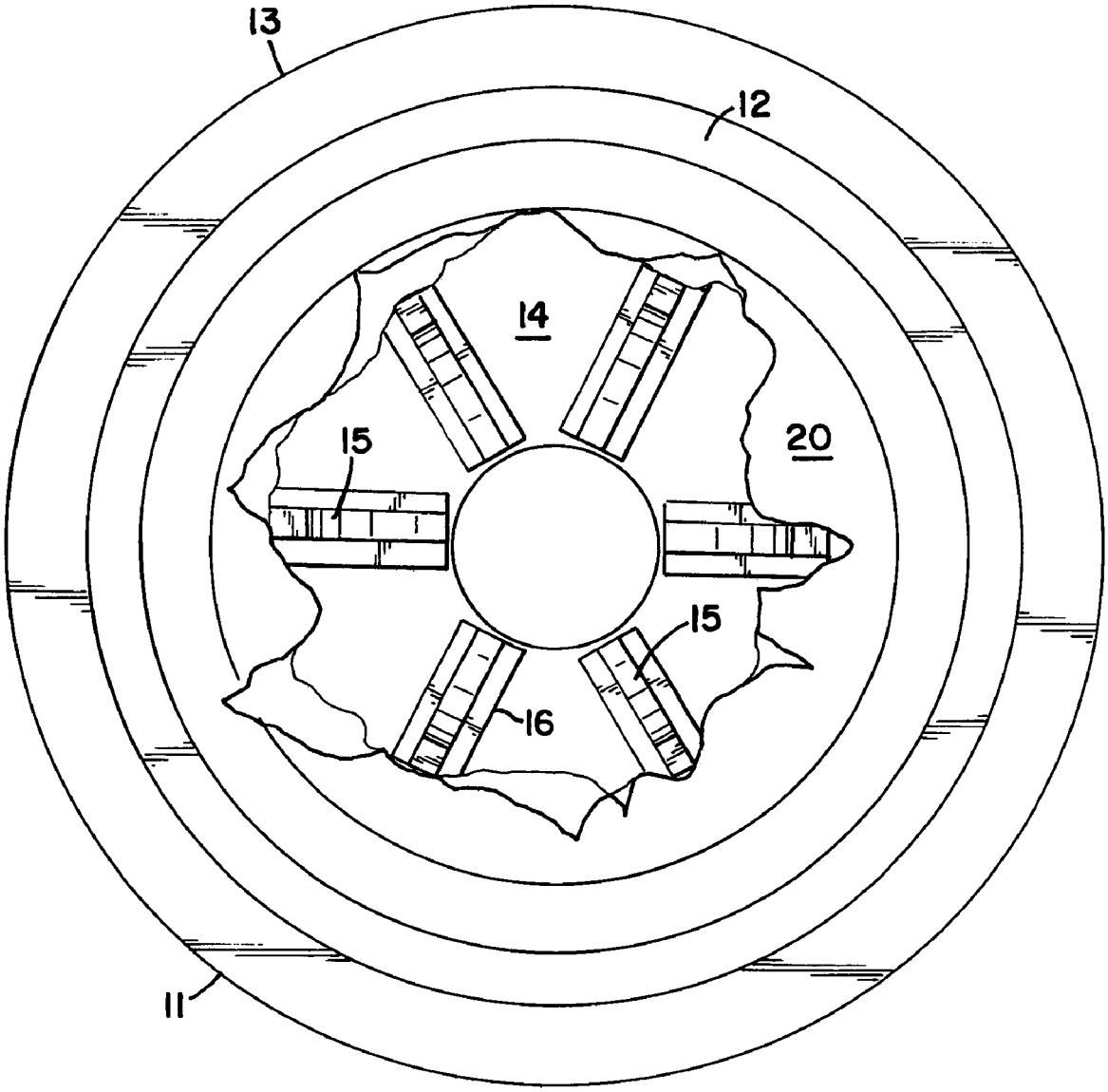
FIG. 6 is a bottom plan view of the container cap of FIG. 2 with the membrane punctured.

The deformable cover is moveable between a first position as shown in FIGS. 2 and 3 to a second position as shown in FIGS. 4, 5 and 6. It should be noted that the membrane 20 is not shown in FIGS. 2 and 4, to provide a clearer view of the levers 15 in these figures. In the first position, the deformable cover 14 has a generally convex configuration and in the second position, it is generally concave. The deformable cover 14 has a circular thinned out area 14*c* that facilitates the deformation of the deformable cover 14 to act as a living hinge. The outer vertical portion 18 does not deflect as the deformable cover 14 is depressed and folds along the thinned area 14*c*. An alternative embodiment could have the entire top member 17 thinned to facilitate the over center operation. In such an embodiment, the flanges 16 are useful in adding lateral stability for the levers 15.

The levers 15 or striking components are molded on an angled section of the deformable cover 14. The levers are at an angle to the membrane and generally point towards the center of the container cap 11. The levers 15 are at an angle A, approximately 120 degrees when the deformable cover 14 is in the first position. When a person presses on the deformable cover 14 and moves it from its first position to its second position, the levers move to the position shown in FIG. 5 and form an angle B or 80 degrees. Optionally, the tips 15*c* may be operatively connected to the membrane 20. The membrane 20 may have a score 20*a* or thin section in a pattern to allow repeatable and predictable ruptures. Alternately, the member 20 does not have to be relieved.

The deformable cover 14 is molded in the concave position as it cannot be molded in the convex position. The top member 17 is larger than the diameter around the vertical portion 18, thereby allowing for the top member to move from the convex position with an over center movement to the concave position.

In operation, the top cap 70, which may include a tamper-resistant connection to the container cap 11, is removed. Then, a user will depress the cover 14 and move the deformable cover 14 from its convex first position to its concave second position. Upon the depressing of the deformable cover 14, the levers 15 will contact the membrane 20 and force it downward, thereby rupturing the membrane 20. As the deformable cover 14 is continued to be depressed, the levers 15 move downward and radially outward. As can be seen in FIG. 2, the levers 15 are all pointed inward towards the center. Then, as seen in FIGS. 4–6, the levers move radially outward. In doing so, the levers 16 will not only puncture the membrane 20, but tear open a larger hole as the levers 15 move radially outward. Such an opening is shown more clearly in FIG. 6. The area of the cover 14 between the levers 15 may be thinned out as well to allow for distortion and for flexing in the transition of the moving from angle A to angle B. As shown in the Figures, the levers are spaced 60 degrees apart for a total of six levers. However, it is appreciated that the spacing could be varied along with the number of levers to achieve either more or less rupture force or more even holding of the membrane. It is preferred that there are at least four levers 15, although less would still be operational.

The storage area formed between the membrane 20 and inner surface 14*b* of the deformable cover 14 forms a storage area for the substance (not shown) to be dispensed. The levers 15 are also in this storage area. The substance to be dispensed may be any suitable substance such as a dry powder or pellet. After the membrane 20 has been ruptured, the substance falls into the cavity 101 of the container 100 and mixes with the liquid 102 to form a suitable drink. The user only needs to shake the container 10 to mix the substance with the liquid to form the drink. Then the container cap 11 is removed and the drink is ready for consumption.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A container cap for use with a container having a cavity, the cavity for holding a liquid and the cavity having an opening, the container cap comprising:

a) an outer peripheral wall forming an open bottom, the bottom adapted and configured to operatively connect to the container;

b) a deformable cover operatively connected to the outer peripheral wall, the deformable cover having an inner surface and an outer surface;

c) the deformable cover having a generally convex, first position and a generally concave, second position;

d) a plurality of levers having a first end operatively connected to the inner surface and a second end adhered to the membrane, the levers pointing toward a center; and e) a puncturable membrane operatively connected to the cap forming a storage area in the cap, the storage area for storing a substance, the storage area including the levers, wherein when the cover is depressed and moves from the first position to the second position, the levers move downward and radially outward, thereby puncturing the membrane and spreading out the punctured membrane creating an opening for the substance in the storage area to drop into the cavity.

2. The container cap of claim 1, wherein an angle of the levers to the membrane changes by at least 40 degrees from the first position to the second position.

3. The container cap of claim 2, wherein the angle changes by at least 50 degrees.

4. The container cap of claim 1, wherein the plurality of levers comprises at least four levers.

5. The container cap of claim 4, wherein the plurality of levers comprises at least six levers.

6. The container cap of claim 5, wherein the substance is a dry substance.

7. The container cap of claim 1, further comprising a flange operatively connected to the first end of the lever for lateral stability.

8. A container for holding a first substance separate from a liquid prior to mixing, the container comprising:

a) a body having an open top, the body defining a cavity for holding a liquid;

b) a cap having an outer peripheral wall forming an open bottom, the bottom adapted and configured to be operatively connected to the open top of the body;

c) a deformable cover operatively connected to the outer peripheral wall, the deformable cover having an inner surface and an outer surface;

d) the deformable cover having a generally convex, first position and a generally concave second position;

e) a plurality of levers having a first end operatively connected to the inner surface and a second end adhered to the membrane, the levers pointing toward a center; and f) a puncturable membrane operatively connected to the cap forming a storage area in the cap, the storage area for storing a substance, the storage area including the levers, wherein when the cover is depressed and moves from the first position to the second position, the levers move downward and radially outward, thereby puncturing the membrane and spreading out the punctured membrane creating an opening for the substance in the storage area to drop into the cavity.

9. The container of claim 8, wherein an angle of the levers to the membrane changes by at least 40 degrees from the first position to the second position.

10. The container of claim 9, wherein the angle changes by at least 50 degrees.

11. The container of claim 8, wherein the plurality of levers comprises at least four levers.

12. The container of claim 11, wherein the plurality of levers comprises at least six levers.

13. The container of claim 12, wherein the substance is a dry substance.

14. The container of claim 8, further comprising a flange operatively connected to the first end of the lever for lateral stability.

* * * * *